US010022932B2

(12) United States Patent
Wnek

(10) Patent No.: US 10,022,932 B2
(45) Date of Patent: Jul. 17, 2018

(54) CONTAINER, FORMING TOOL, AND METHOD FOR FORMING A CONTAINER

(71) Applicant: Graphic Packaging International, Inc., Atlanta, GA (US)

(72) Inventor: Patrick H. Wnek, Sherwood, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 14/843,156

(22) Filed: Sep. 2, 2015

(65) Prior Publication Data

US 2015/0375468 A1 Dec. 31, 2015

Related U.S. Application Data

(62) Division of application No. 13/294,245, filed on Nov. 11, 2011.

(Continued)

(51) Int. Cl.
*B65D 5/42* (2006.01)
*B31B 1/00* (2006.01)

(Continued)

(52) U.S. Cl.
CPC ..... *B31B 1/00* (2013.01); *B65D 1/34* (2013.01); *B65D 5/2023* (2013.01); *B65D 5/4266* (2013.01); *B65D 81/3446* (2013.01); *B65D 81/3453* (2013.01); *H05B 6/6408* (2013.01); *B31B 50/0012* (2017.08); *B31B 50/44* (2017.08); *B65D 2581/344* (2013.01); *B65D 2581/3447* (2013.01); *B65D 2581/3471* (2013.01); *B65D 2581/3472* (2013.01); *B65D 2581/3477* (2013.01); *B65D 2581/3479* (2013.01); *B65D 2581/3495* (2013.01); *B65D 2581/3497* (2013.01)

(58) Field of Classification Search
CPC ..... B65D 81/3453; B65D 21/0233
USPC ..... 219/725; 206/515; 428/34.2; 229/407, 229/906; 99/340
See application file for complete search history.

(56) References Cited

U.S. PATENT DOCUMENTS 1,022,882 A 4/1912 Schwenn
1,986,824 A 1/1935 Keiding
(Continued)

FOREIGN PATENT DOCUMENTS

DE 509 065 4/1969
DE 80 11 020 9/1980
(Continued)

OTHER PUBLICATIONS

International Search Report and Written Opinion for PCT/US2011/060288 dated May 16, 2012.
(Continued)

*Primary Examiner* — Jimmy Chou
(74) *Attorney, Agent, or Firm* — Womble Bond Dickinson (US) LLP

(57) ABSTRACT

A container formed from a blank, a forming, tool and a method of forming a container are disclosed. The container includes features that are formed by a plurality of score lines in a marginal portion of the blank. The container has a bottom wall, a side wall, and a flange extending from the side wall. The flange has a thickness that is greater than a thickness of the blank.

17 Claims, 13 Drawing Sheets

Related U.S. Application Data

(60) Provisional application No. 61/456,801, filed on Nov. 12, 2010.

(51) Int. Cl.

| | |
|---|---|
| ***B65D 1/34*** | (2006.01) |
| ***B65D 81/34*** | (2006.01) |
| ***H05B 6/64*** | (2006.01) |
| ***B65D 5/20*** | (2006.01) |
| *B31B 50/44* | (2017.01) |
| *B31B 50/00* | (2017.01) |

(56) References Cited

U.S. PATENT DOCUMENTS 2,387,778 A 10/1945 Stocking
2,634,880 A * 4/1953 Gravatt ..... B65F 1/08 220/212.5
2,831,623 A 4/1958 Lavigne
3,033,434 A * 5/1962 Carson ..... B21D 51/2646 220/574
3,195,770 A 7/1965 Robertson
3,220,631 A 11/1965 Reifers
3,229,886 A 1/1966 Grogel
3,530,917 A 9/1970 Donovan
3,669,305 A 6/1972 Kinney et al.
3,677,436 A 7/1972 Danielson
3,749,276 A 7/1973 Davis
3,836,042 A 9/1974 Petito
3,850,340 A 11/1974 Siemonsen et al.
3,927,766 A 12/1975 Day
3,968,921 A 7/1976 Jewell
4,026,458 A * 5/1977 Morris ..... B65D 1/28 229/170
4,051,707 A 10/1977 Valek et al.
4,054,229 A 10/1977 Arfert
4,096,947 A 6/1978 Morse
4,111,303 A 9/1978 Compton
4,202,464 A 5/1980 Mohs et al.
4,355,755 A 10/1982 Faller
4,420,081 A 12/1983 Dart
4,471,901 A * 9/1984 Stahlecker ..... B65D 3/08 229/106
4,542,029 A 9/1985 Caner et al.
4,606,496 A * 8/1986 Marx ..... B65D 1/34 220/574
4,623,088 A * 11/1986 Holden ..... B65D 1/34 229/407
4,641,005 A * 2/1987 Seiferth ..... A47J 36/022 156/233
4,663,506 A * 5/1987 Bowen ..... A47J 36/027 219/730
4,721,499 A * 1/1988 Marx ..... B65D 1/34 264/324
4,775,560 A * 10/1988 Katsura ..... B65D 81/3446 229/5.84
4,832,202 A 5/1989 Newman et al.
4,952,765 A 8/1990 Toyosawa
4,967,908 A 11/1990 Kessler
5,083,699 A * 1/1992 Bulcher ..... B65D 1/34 229/125.17
5,105,947 A 4/1992 Wise
5,117,078 A * 5/1992 Beckett ..... B65D 81/3453 219/728
5,172,628 A * 12/1992 Pillsbury ..... A47J 37/0745 99/419
5,176,284 A 1/1993 Sorensen
5,203,491 A * 4/1993 Marx ..... A21B 3/131 220/573.1
5,230,939 A * 7/1993 Baum ..... A47G 19/03 220/574
5,236,119 A * 8/1993 Chu ..... B65D 1/36 220/527
5,269,717 A * 12/1993 Tardif ..... A47G 19/025 206/457
5,326,020 A * 7/1994 Cheshire ..... A47G 19/03 220/657
5,447,736 A 9/1995 Gorlich
5,617,972 A * 4/1997 Morano ..... A61J 9/001 206/519
5,698,127 A * 12/1997 Lai ..... B65D 81/3446 219/728
5,715,744 A * 2/1998 Coutant ..... A47J 37/0745 99/419
5,721,022 A 2/1998 Morita et al.
5,782,376 A 7/1998 Brauner et al.
5,938,112 A * 8/1999 Sandstrom ..... A47G 19/03 162/175
6,093,460 A * 7/2000 Iwaya ..... B31F 1/0087 156/224
6,150,646 A * 11/2000 Lai ..... B65D 77/042 219/728
6,213,301 B1 4/2001 Landis et al.
6,270,003 B1 8/2001 Hirano
6,325,213 B1 12/2001 Landis, II
6,415,945 B1 7/2002 Zank et al.
6,455,827 B2 * 9/2002 Zeng ..... B65D 81/3453 219/728
6,568,534 B2 5/2003 Zank
6,651,874 B1 * 11/2003 Pedersen ..... B32B 27/10 229/123.1
6,717,121 B2 * 4/2004 Zeng ..... A47J 36/027 219/728
6,847,022 B2 * 1/2005 Hopkins, Sr. ..... B65D 77/225 219/725
6,988,654 B2 * 1/2006 Wnek ..... B65D 21/0233 229/406
7,021,203 B2 * 4/2006 Backus ..... A47J 37/041 99/421 H
7,048,176 B2 * 5/2006 Littlejohn ..... A47G 19/03 220/574
7,069,842 B1 * 7/2006 Liao ..... A47J 37/041 99/419
7,105,788 B2 * 9/2006 Hopkins ..... B65D 77/225 219/725
7,164,850 B1 * 1/2007 Ho ..... A47J 37/041 392/407
7,451,910 B2 11/2008 Frost et al.
D583,192 S * 12/2008 Pailevanian ..... D7/409
7,514,651 B2 * 4/2009 Popeil ..... A47J 37/042 219/392
7,626,142 B2 * 12/2009 Backus ..... A47J 37/041 219/403
7,819,790 B2 * 10/2010 Grischenko ..... B31B 43/00 100/215
7,914,432 B2 * 3/2011 Zelinski ..... B31B 43/00 271/195
7,946,223 B2 * 5/2011 Raichlen ..... A47J 37/049 99/419
7,980,450 B2 * 7/2011 Swoboda ..... A47G 19/03 229/406
8,011,568 B2 * 9/2011 Maeaettae ..... B29C 43/203 229/125.35
8,106,339 B2 * 1/2012 Robbins ..... B65D 81/3453 219/730
8,177,119 B2 * 5/2012 Littlejohn ..... B65D 1/34 220/608
8,414,464 B2 * 4/2013 Grischenko ..... B31B 43/00 493/143
8,464,871 B2 * 6/2013 Wnek ..... B31B 43/00 206/557
8,474,689 B2 * 7/2013 Littlejohn ..... B31B 17/00 220/574
8,534,460 B2 * 9/2013 Wnek ..... B65D 1/34 206/515
8,584,929 B2 * 11/2013 Littlejohn ..... B65D 1/34 220/574
8,651,366 B2 * 2/2014 Littlejohn ..... B31B 43/00 220/574

(56) References Cited

U.S. PATENT DOCUMENTS 8,721,321 B2 * 5/2014 Middleton ..... B29C 45/14336 264/294
8,777,010 B2 * 7/2014 Wnek ..... A47G 19/03 206/499
8,785,826 B2 * 7/2014 Lai ..... B65D 81/3453 219/728
8,801,995 B2 * 8/2014 Wnek ..... B31B 43/00 264/252
2002/0092791 A1 * 7/2002 Wnek ..... B65D 21/0233 206/519
2002/0113118 A1 * 8/2002 Littlejohn ..... A47G 19/03 229/407
2003/0205319 A1 * 11/2003 Bengtsson ..... B32B 27/10 156/278
2004/0262322 A1 * 12/2004 Middleton ..... B29C 45/14336 220/675
2005/0109653 A1 * 5/2005 Wnek ..... B65D 1/34 206/515
2006/0198972 A1 * 9/2006 Ueda ..... B31B 45/00 428/35.2
2006/0289522 A1 * 12/2006 Middleton ..... B65D 77/0433 219/730
2007/0017920 A1 * 1/2007 Davis ..... B65D 1/26 220/608
2007/0194029 A1 * 8/2007 Middleton ..... B29C 45/14336 220/659
2007/0235514 A1 * 10/2007 Abayhan ..... A47G 19/03 229/407
2007/0267374 A1 * 11/2007 Middleton ..... B29C 45/14336 211/126.1
2008/0251574 A1 * 10/2008 Zelinski ..... B31B 43/00 229/407
2008/0314897 A1 * 12/2008 Lion ..... A21B 3/135 220/9.4
2009/0173775 A1 * 7/2009 Swoboda ..... A47G 19/03 229/407
2009/0173776 A1 * 7/2009 Swoboda ..... A47G 19/03 229/407
2010/0082265 A1 * 4/2010 Song ..... C02F 1/008 702/25
2010/0147938 A1 * 6/2010 Littlejohn ..... B31B 17/00 229/407
2011/0012291 A1 * 1/2011 Middleton ..... B29C 45/14336 264/266
2011/0272317 A1 * 11/2011 Wnek ..... B65D 1/34 206/515
2012/0118880 A1 * 5/2012 Wnek ..... B31B 1/00 219/725
2013/0244849 A1 * 9/2013 Wnek ..... B31B 43/00 493/162
2014/0103038 A1 * 4/2014 Wnek ..... B65D 1/28 220/62
2014/0191024 A1 * 7/2014 Wnek ..... B65D 1/34 229/407

FOREIGN PATENT DOCUMENTS

| | | | |
|---|---|---|---|
| DE | 87 13 290.7 | | 1/1988 |
| DE | 37 37 052 | A1 | 5/1989 |
| DE | 296 02 348 | U1 | 5/1996 |
| DE | 101 49 143 | A1 | 4/2003 |
| FR | 2 266 638 | | 10/1975 |
| FR | 2 599 002 | | 11/1987 |
| GB | 609142 | | 9/1948 |
| GB | 961 595 | A | 6/1964 |
| GB | 961204 | | 6/1964 |
| GB | 1 264 484 | | 2/1972 |
| GB | 1 376 603 | | 12/1974 |
| GB | 2 061 699 | | 5/1981 |
| JP | 3031361 | | 9/1996 |
| JP | 8-337234 | | 12/1996 |
| JP | 2000-517260 | | 12/2000 |
| JP | 2005-519819 | A | 7/2005 |
| WO | WO 96/11142 | | 4/1996 |
| WO | WO 98/09812 | | 3/1998 |
| WO | WO 03/078012 | A1 | 9/2003 |
| WO | WO 2004/033324 | | 4/2004 |
| WO | WO 2008/049048 | | 4/2008 |
| WO | WO 2011/0285588 | | 3/2011 |

OTHER PUBLICATIONS

Notification of Reason for Refusal for Application No. 2013-538917 dated Jul. 3, 2014, with English translation.
Office Action for U.S. Appl. No. 13/294,245 dated Jul. 7, 2014.
Response to Restriction Requirement for U.S. Appl. No. 13/294,245 dated Aug. 7, 2014.
Office Action for U.S. Appl. No. 13/294,245 dated Sep. 8, 2014.
Amendment A and Response to Office Action for U.S. Appl. No. 13/294,245 dated Dec. 5, 2014.
Office Action for U.S. Appl. No. 13/294,245 dated Mar. 17, 2015.
Response to Final Office Action for U.S. Appl. No. 13/294,245 dated May 22, 2015.
Office Action for U.S. Appl. No. 13/294,245 dated Jun. 3, 2015.
Request for Continued Examination (RCE) Transmittal for U.S. Appl. No. 13/294,245 dated Sep. 1, 2015.
Amendment B and Response ton Final Office Action for U.S. Appl. No. 13/294,245 dated Sep. 1, 2015.
Supplementary European Search Report for EP 11 83 9549 dated Dec. 15, 2017.

* cited by examiner

CONTAINER, FORMING TOOL, AND METHOD FOR FORMING A CONTAINER

CROSS-REFERENCE TO RELATED APPLICATIONS

This application is a divisional application of U.S. patent application Ser. No. 13/294,245, filed Nov. 11, 2011, which application claims the benefit of U.S. Provisional Patent Application No. 61/456,801, filed Nov. 12, 2010.

INCORPORATION BY REFERENCE

The disclosures of U.S. patent application Ser. No. 13/294,245, which was filed Nov. 11, 2011, and U.S. Provisional Patent Application No. 61/456,801, which was filed Nov. 12, 2010, are hereby incorporated by reference for all purposes as if presented herein in their entirety.

BACKGROUND OF THE DISCLOSURE

The present disclosure relates to blanks, containers, trays, constructs, forming tools and various features to facilitate forming a container from a blank.

SUMMARY OF THE DISCLOSURE

In one aspect, the disclosure is generally directed to a container formed from a blank. The container includes features that are formed by a plurality of score lines in a marginal portion of the blank. The container has a bottom wall, a side wall, and a flange extending from the side wall. The flange has a thickness that is greater than a thickness of the blank.

In another aspect, the disclosure is generally directed to a tool for forming a container from a blank. The tool comprises a first tool assembly and a second tool assembly. At least one of the first tool assembly and the second tool assembly is moveable between an open position wherein the blank is received between the first and the second tool assembly and a closed position wherein the blank is formed into the container. At least one of the first and the second tool assembly has features to facilitate forming the container from the blank.

In another aspect, the disclosure is generally directed to a method of forming a container from a blank. The method comprises obtaining a forming tool comprising a first tool assembly and a second tool assembly. The method comprises moving at least one of the first tool assembly and the second tool assembly to an open position and positioning the blank between the first and second tool assembly, and moving the at least one of the first and second tool assembly to a closed position wherein the blank is formed into the container. A flange of the formed container is formed in a manner that the flange has a thickness greater than the thickness of the blank.

In another aspect, the disclosure is generally directed to a container for holding and heating a food product. The container comprises a bottom panel and at least one side panel extending upwardly from the bottom panel. The bottom panel and the at least one side panel cooperate to at least partially define a cavity of the container. A flange extends laterally outward from an upper edge of the at least one side panel. Pleats extend in at least a portion of the flange. The flange has a first thickness and the side panel has a second thickness. The first thickness is greater than the second thickness.

In another aspect, the disclosure is generally directed to a method of manufacturing a container for holding and heating a food product. The method comprises obtaining a blank comprising a central portion, an outer edge, and a marginal portion between the outer edge and the central portion. The blank comprises a radius extending from a center of the blank to the outer edge. The marginal portion comprises a plurality of radial score lines having an angular spacing between respective adjacent radial score lines. The blank has a first thickness. The method comprises closing the blank in a forming tool so that the blank is formed into a container having a bottom panel, at least one side panel extending upwardly from the bottom panel, and a flange extending laterally outward from an upper edge of the at least one side panel. The closing the blank in the foaming tool comprises forming a cavity by upwardly folding the side panel relative to the bottom panel, and forming pleats at the radial score lines. The pleats extending in at least a portion of the flange wherein the flange has a second thickness. The second thickness being at least approximately two times the first thickness.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 6:
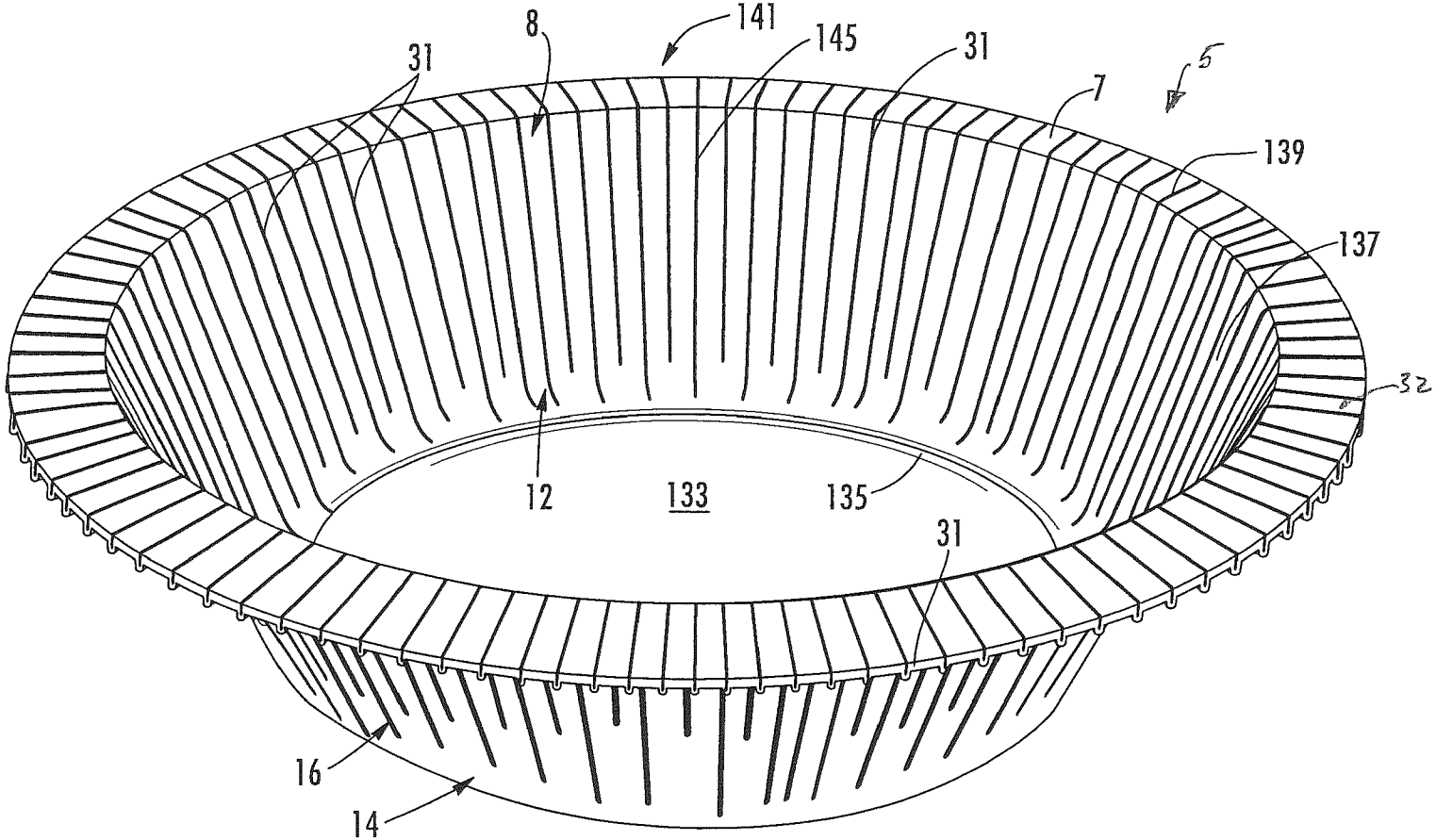
FIG. 6 is a perspective view of a container of a second embodiment of the disclosure.
Figure 12:
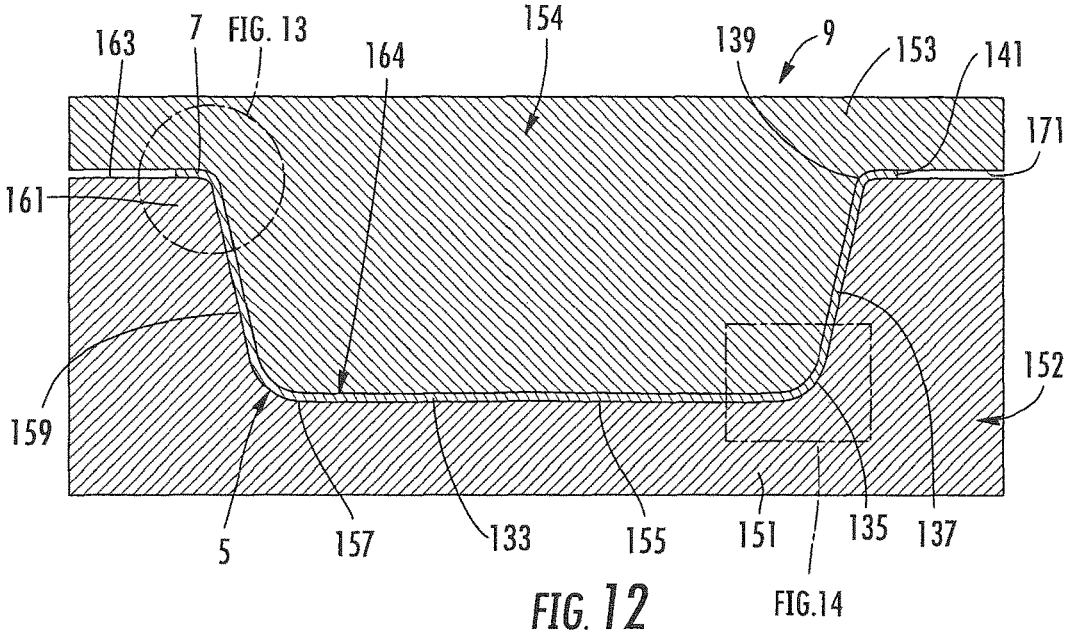
FIG. 12 is a partial cross-section of a forming tool of one embodiment of the disclosure.
Figure 13:
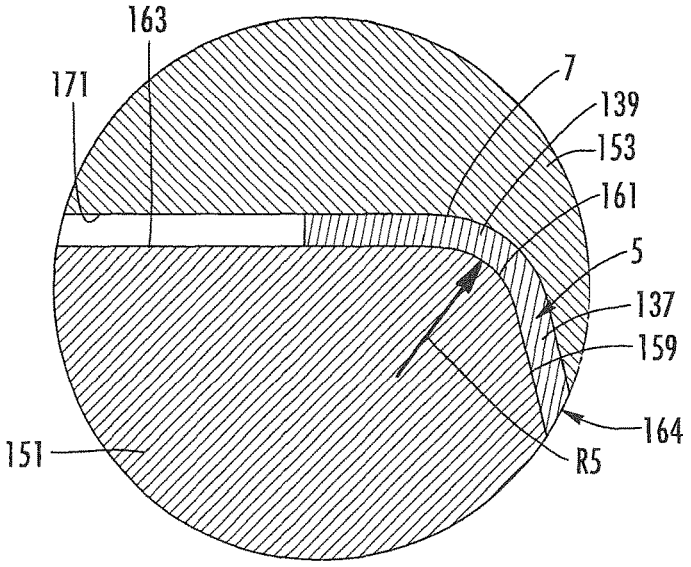
FIG. 13 is an enlarged portion of FIG. 12.
Figure 14:
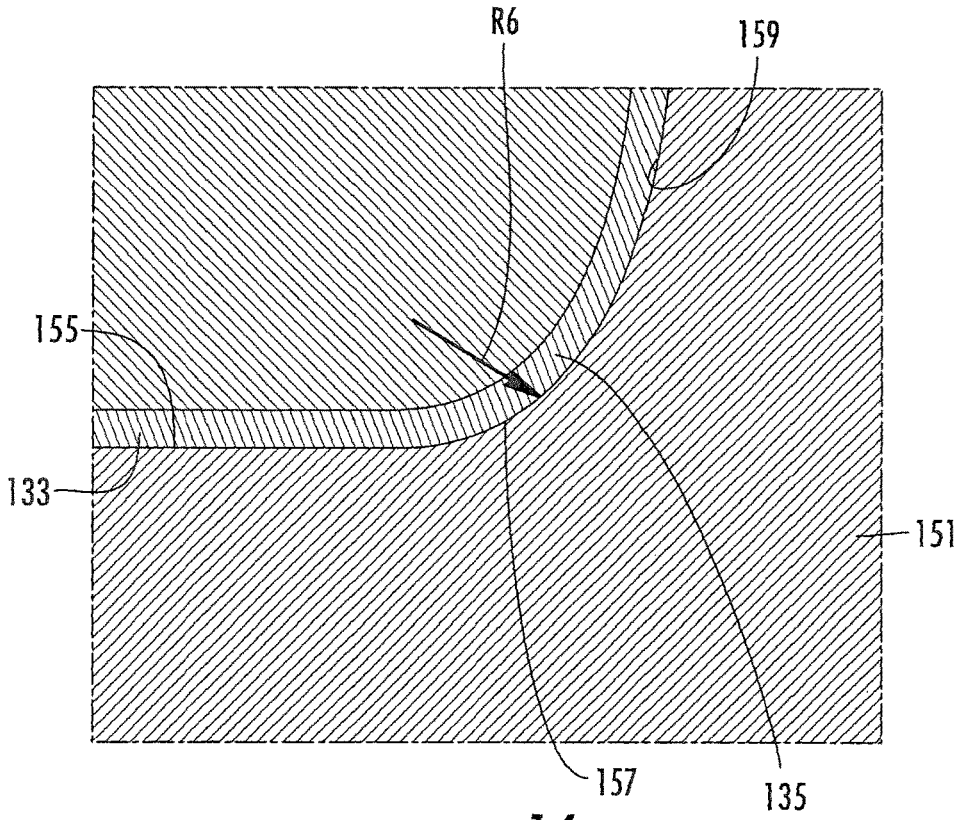
FIG. 14 is an enlarged portion of FIG. 12.

FIGS. 1-4 illustrate a blank 3 that is used to form a container 5 (FIG. 6) having a flange 7. In the illustrated embodiment, the blank 3 is generally circular and is for being press formed into the container 5 that, in the illustrated embodiment, is a generally circular tray. It is understood that the blank 3 can be press-formed into the container 5 by a forming tool 9 (FIGS. 12-14). The forming tool 9 can be similar to and have similar features and/or components conventional forming tools such as are disclosed in U.S. Patent Application Publication No. 2005/0109653, the entire contents of which are incorporated herein by reference for all purposes. Also, the forming tool 9 can have similar features and components such as the forming tool disclosed in International Publication No. WO 2008/049048 ("the '048 publication"), the entire contents of which are incorporated by reference for all purposes, or any other suitable forming tool assembly. Also, the blanks 3 and the container 5 could be shapes other than circular (e.g., oval, rectangular, irregular, etc) without departing from the scope of this disclosure. The blanks 3 of the present disclosure have features that allow the container 5 made from each blank to have a flange 7 that is a substantially uniform width around the perimeter of the container.

Figure 1:
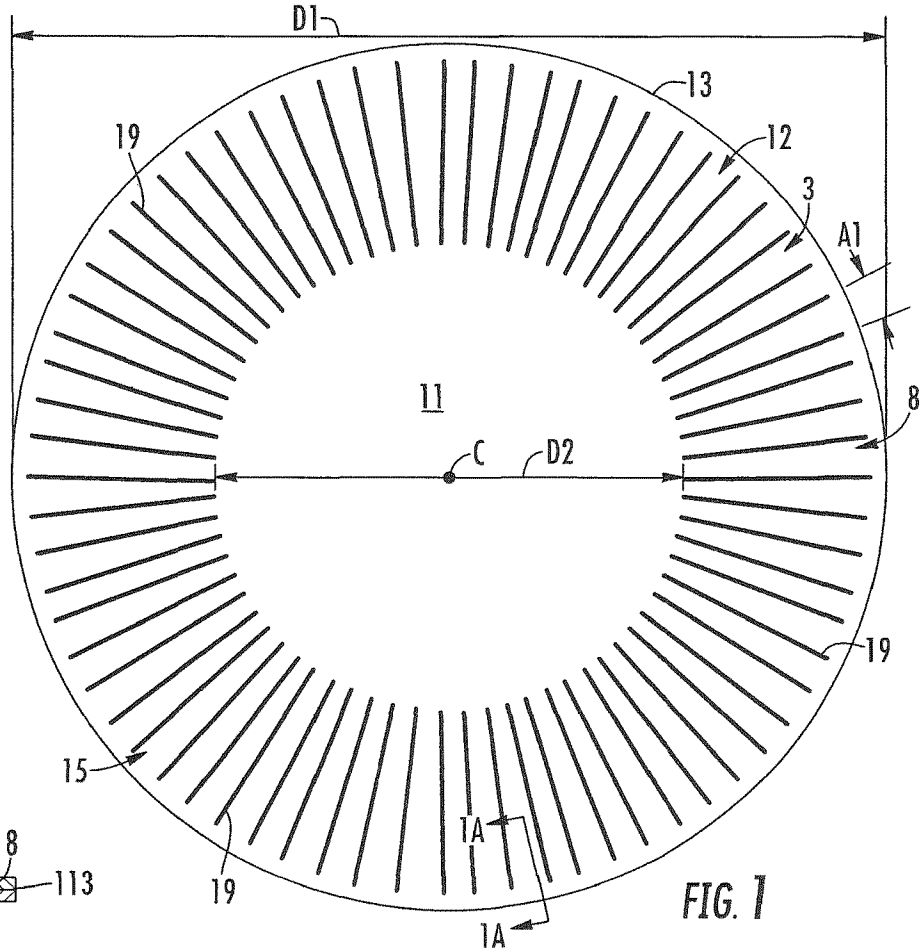
FIG. 1 is a plan view of an interior surface of a blank used for forming a container of one or more embodiments of the disclosure.
Figure 1A:
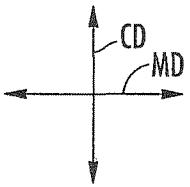
FIG. 1A is a partial cross-section taken along the plane indicated 1A-1A of FIG. 1.
Figure 1A:
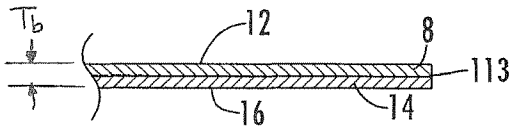
Figure 2:
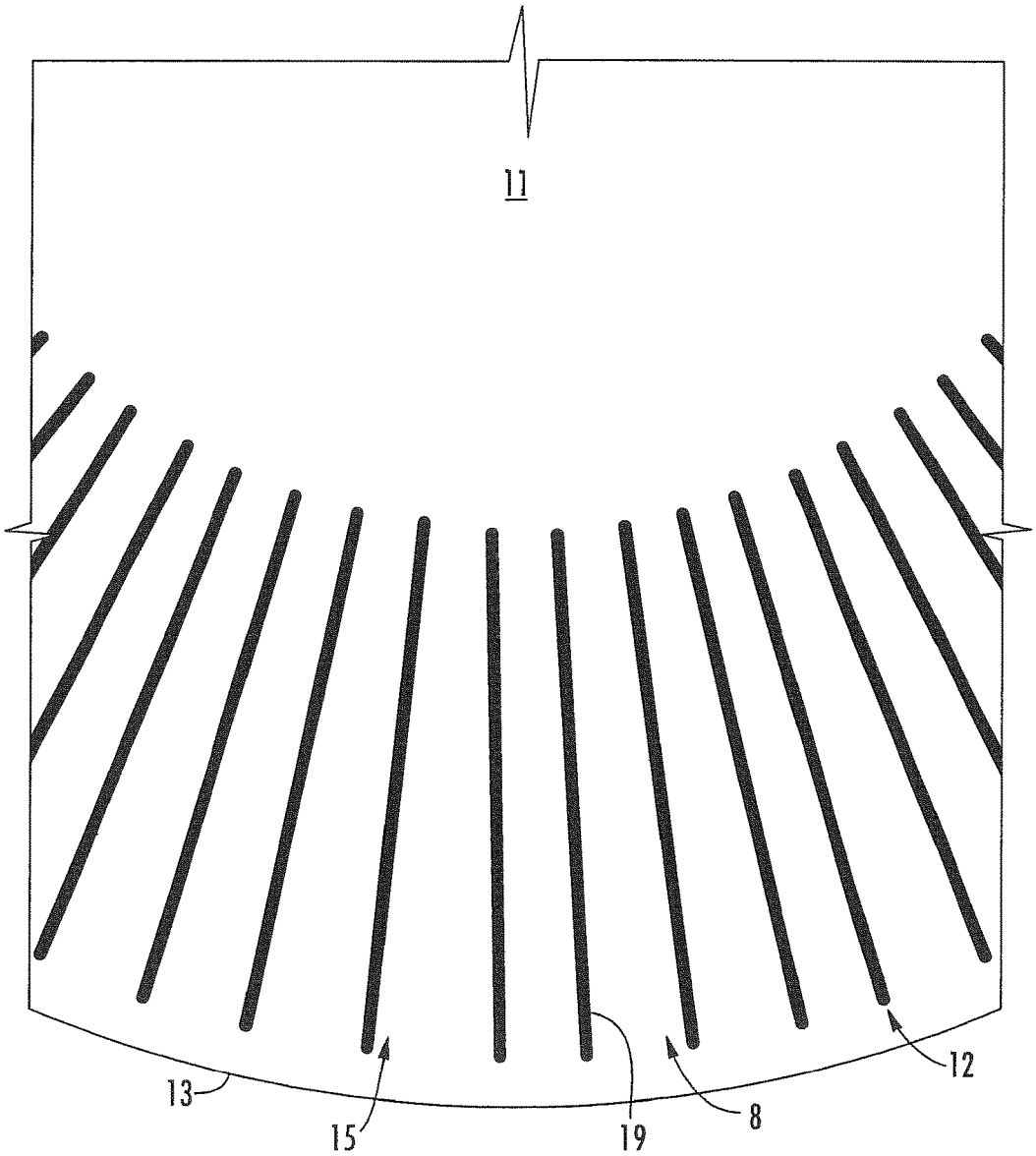
FIG. 2 is an enlarged portion of FIG. 1.
Figure 3:
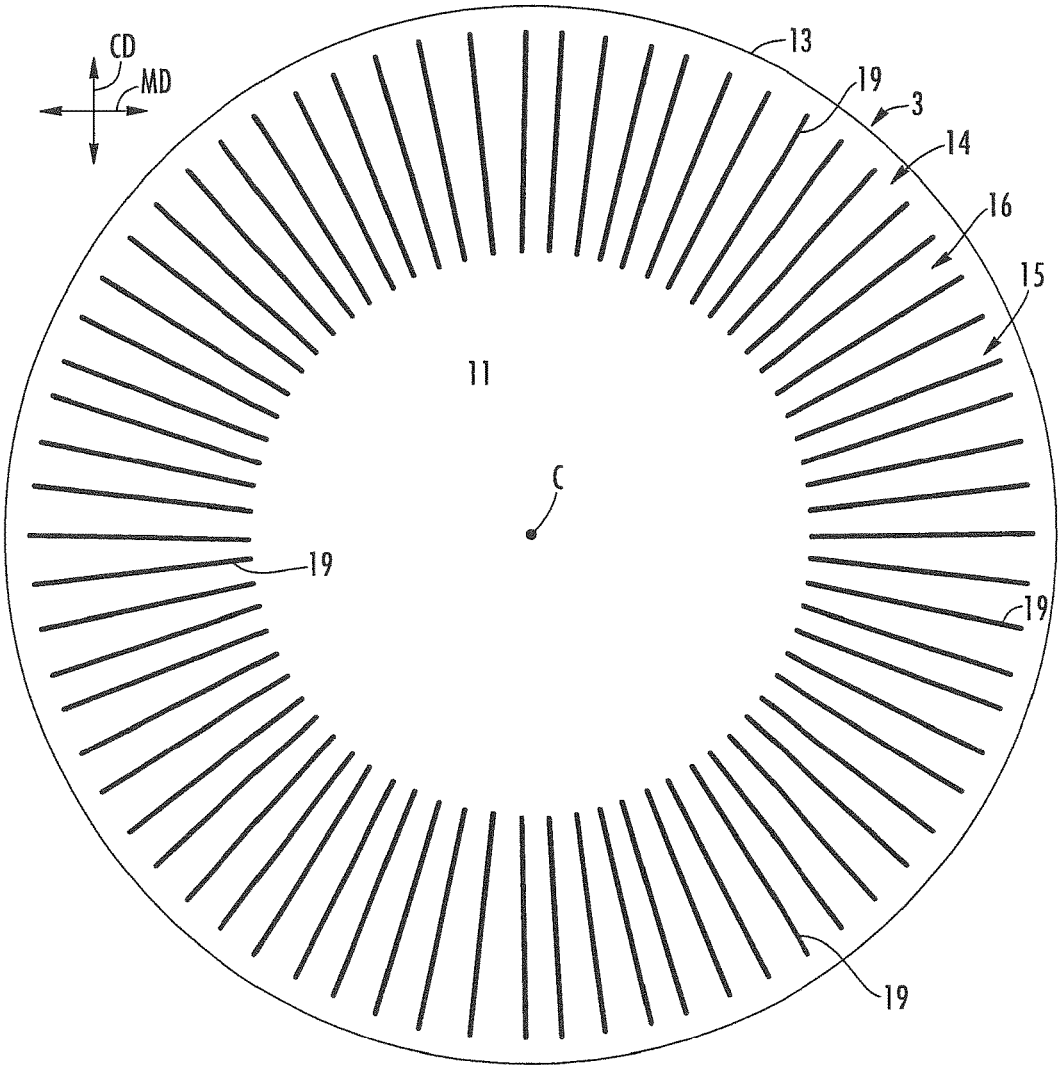
FIG. 3 is a plan view of an exterior surface of the blank of FIG. 1.
Figure 4:
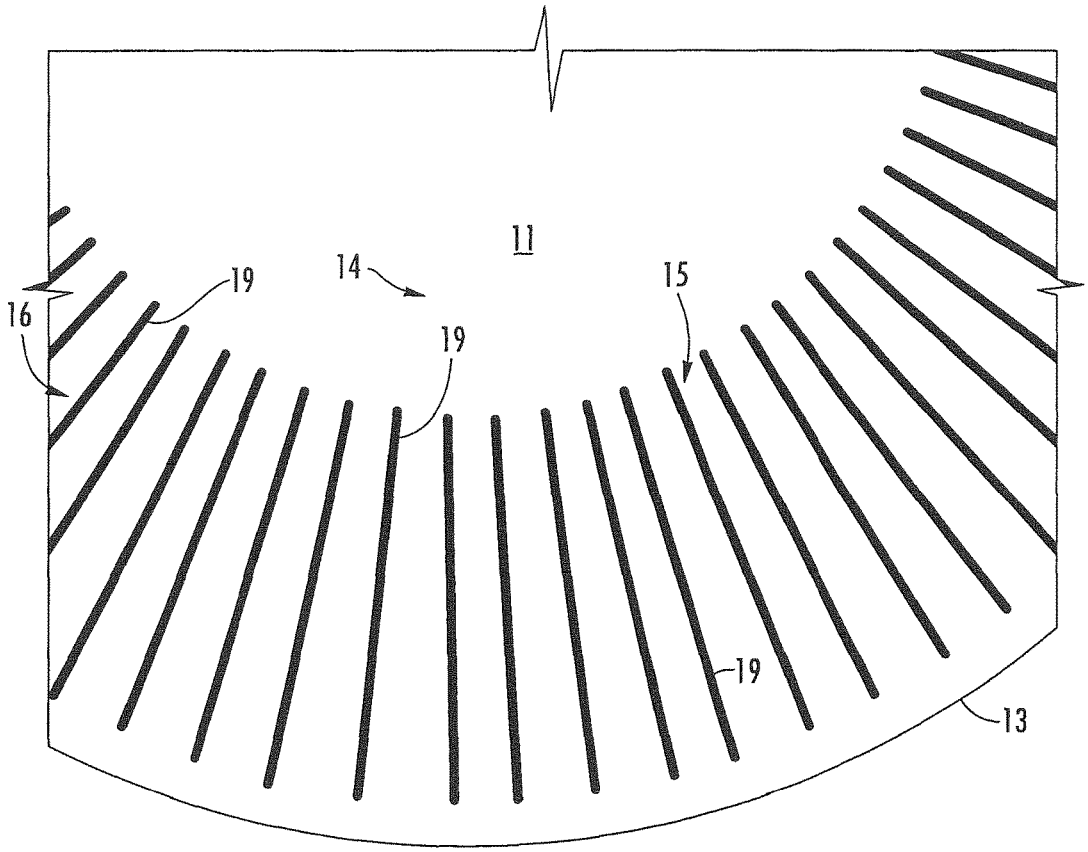
FIG. 4 is an enlarged portion of FIG. 3.

The blank 3 can be formed from a laminate that includes more than one layer, but alternatively the laminate can be replaced with a single ply of material, such as, but not limited to, paperboard, cardboard, paper or a polymeric sheet. In accordance with the exemplary embodiments of the present disclosure, the laminate can includes a microwave interactive layer 8 such as is common in MicroRite® containers available from Graphic Packaging International of Marietta, Ga. The microwave interactive layer can be commonly referred to as, or can have as one of its components, a foil, a microwave shield, or any other term or component that refers to a layer of material suitable for causing heating in a microwave oven. The microwave interactive layer 8 comprises the inner/interior surface 12 of the blank 3 (FIGS. 1-2). In the illustrated embodiment, the blank 3 has a base layer 14 forming an outer/exterior surface 16 (FIGS. 1A, 3, and 4) of the blank 3. The microwave, interactive layer 8 is supported by, and secured to, the base layer 14 that can be in the form of paperboard, cardboard, or any other suitable material. Nonetheless and in accordance with the exemplary embodiments, the base layer 14 typically is a clay-coated paperboard. The microwave interactive layer 8 can be other suitable microwave interactive materials set forth below, or any other suitable material.

As shown in FIG. 1, the blank 3 has a machine direction MD corresponding to the direction that the paperboard base layer 14 was produced when it was made on the paper forming machine. The machine direction MD represents the general direction of the cellulose fiber alignment within the paperboard 14. The blank 3 has a cross-machine direction CD that is perpendicular to the machine direction MD. The blank 3 has a central portion 11, an outer edge 13, and a marginal portion 15 between the outer edge and the central portion. In one embodiment, the marginal portion 15 of the blank 3 includes a plurality of score lines 19. The score lines 19 are all positioned in the marginal portion 15 such that the score lines extend generally radially from the center C of the blank (e.g., the score lines would not intersect each other and would intersect the center of the blank if the score lines were extended past the marginal portion). In one embodiment, adjacent score lines 19 are spaced apart by an angle A1 of at least approximately 5 degrees that is uniform around the perimeter of the blank. In one embodiment, the score lines 19 have a radially outer end point that is spaced in from the outer edge 13 of the blank 3, but the score lines could extend to the outer edge of the blank without departing from the disclosure. Also, in one embodiment, the score lines 19 are formed on the interior surface 12 such the score lines 19 comprise slight indentations in the interior surface 12 of the blank on the surface of the microwave interactive layer 8 and slight protrusions on the exterior surface 16 of the blank on the outer surface of the paperboard layer 14. The score lines 19 could be otherwise shaped, arranged, and/or configured without departing from the disclosure. The central portion 11 can be substantially free of any fold lines, score line, or other line of weakening, without departing from the disclosure. Alternatively, the central portion 11 can have a line of weakening to facilitate forming the blank 3 into the container 5 without departing from the disclosure.

In one embodiment, the blank 3 has a diameter D1 of at least approximately 7.75 inches (197 mm), the central portion 11 has a diameter D2 between respective ends of the score lines 19 of at least approximately 4.125 inches (105 mm). In the embodiment of FIG. 1, the blank 3 has 72 score lines 19, each respectively spaced apart by an angle A1 of approximately five degrees, but more or less than 72 score lines could be provided and the angle A1 could be more or less than five degrees. As shown in FIG. 1A, the blank 3 has a thickness $T_b$ of approximately The score lines 19 of the blank 3 can be otherwise shaped, arranged, and/or configured without departing from the scope of this disclosure. In one embodiment, the paperboard base layer 14 of the blank 3 can comprise 18 point paperboard having a thickness of approximately 0.018 inch (0.46 mm), and the microwave interactive layer 8 can have a thickness of approximately 0.001 inch (0.025 mm) so that the blank 3 has a total thickness $T_b$ of approximately 0.019 inch (0.48 mm). In one embodiment, the thickness of the paperboard base layer 14 can be in the range of approximately 0.013 inch (0.33 mm) to approximately 0.023 inch (0.58 mm), the thickness of the microwave interactive layer 8 can be in the range of approximately 0.0005 inch (0.013 mm) to approximately 0.0015 inch (0.038 mm), and the total thickness $T_b$ in the range of approximately 0.0135 inch (0.34 mm) to approximately 0.0245 inch (0.62 mm). Any of the above noted thicknesses or other dimensions noted above could be larger or smaller than noted or could be inside or outside the listed ranges without departing form the scope of the disclosure. All of the dimensional information presented herein is intended to be illustrative of certain aspects of the disclosure and is not intended to limit the scope of the disclosure, as various other embodiments of the disclosure could include dimensions that are greater than or less than the dimensions included herein.

Figure 5:
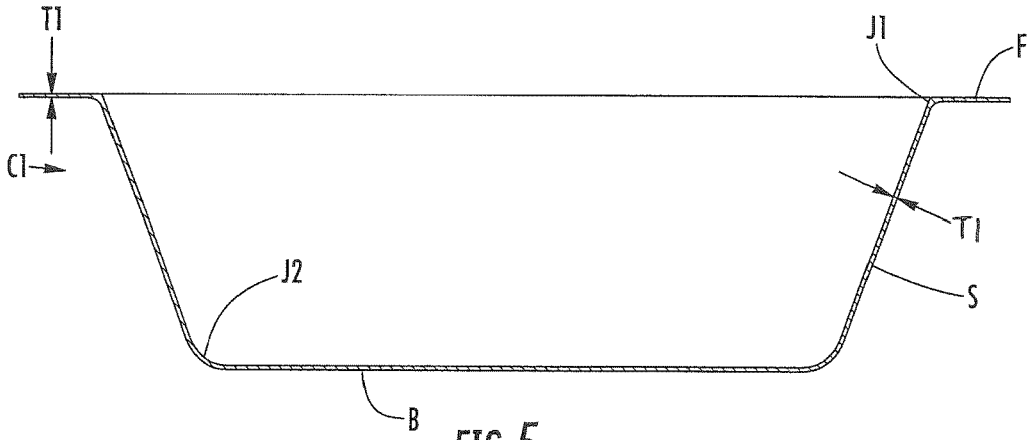
FIG. 5 is a section view of a container of a first embodiment of the disclosure.

FIG. 5 shows a container C1 that can be formed from the blank 3. The container C1 has a flange F extending outward from an annular side wall S of the container. The side wall S extends upwardly from a generally flat bottom wall B of the container C1. In the embodiment of FIG. 5, the flange F and the side wall S are compressed when the blank 3 is formed in a forming tool. The score lines 19 form partially overlapping portions of material or pleats in the container C1. The pleats formed by the score lines extend in the side wall S and the flange F and are compressed when the container C1 is formed. In the embodiment of FIG. 5, the overlapping portions of material that form the pleats are substantially compressed so that the flange F and the side walls S have a substantially uniform thickness. The flange F and sidewall S have a thickness T1 of approximately 0.025 inch (0.64 mm). The flange F meets the side wall S at a junction J1 that is curved and has a radius of approximately 0.062 inch (0.16 mm). The sidewall S meets the bottom wall B at a junction J2 that is curved and has a radius of approximately 0.250 inch (6.4 mm).

FIGS. 6-9 show one embodiment of the disclosure comprising a container 5 formed from the blank 3. The container 5 comprises a generally flat bottom wall 133, a bottom corner 135 that connects the bottom wall to an annular side wall 137, an upper corner 139 that connects the side wall 137 to the flange 7, and an outer radial edge 141. The bottom wall 133 and side wall 137 at least partially define an interior space or cavity 145 of the container 5. The microwave interactive element 8 is on the inner/interior surface 12 of the container 5 and the base layer 14 is on the outer/exterior surface 16 of the container. The container 5 is for holding and cooking and/or heating a food product (not shown) that is placed in the interior space 145 of the container.

In the illustrated embodiment, when the blank 3 is formed into the container 5, the score lines 19 form overlapped portions or pleats 31. Some of the overlapped portions 31 are protrusions that protrude outwardly from the exterior surface 16 of the container 5. In the illustrated embodiment, the overlapped portions 31 are in the flange 7 of the container and the side wall 137, and extend down the side wall to a location adjacent the bottom wall 133. The overlapped portions 31 or protrusions could be otherwise shaped, arranged, and/or configured without departing from the disclosure.

Figure 7:
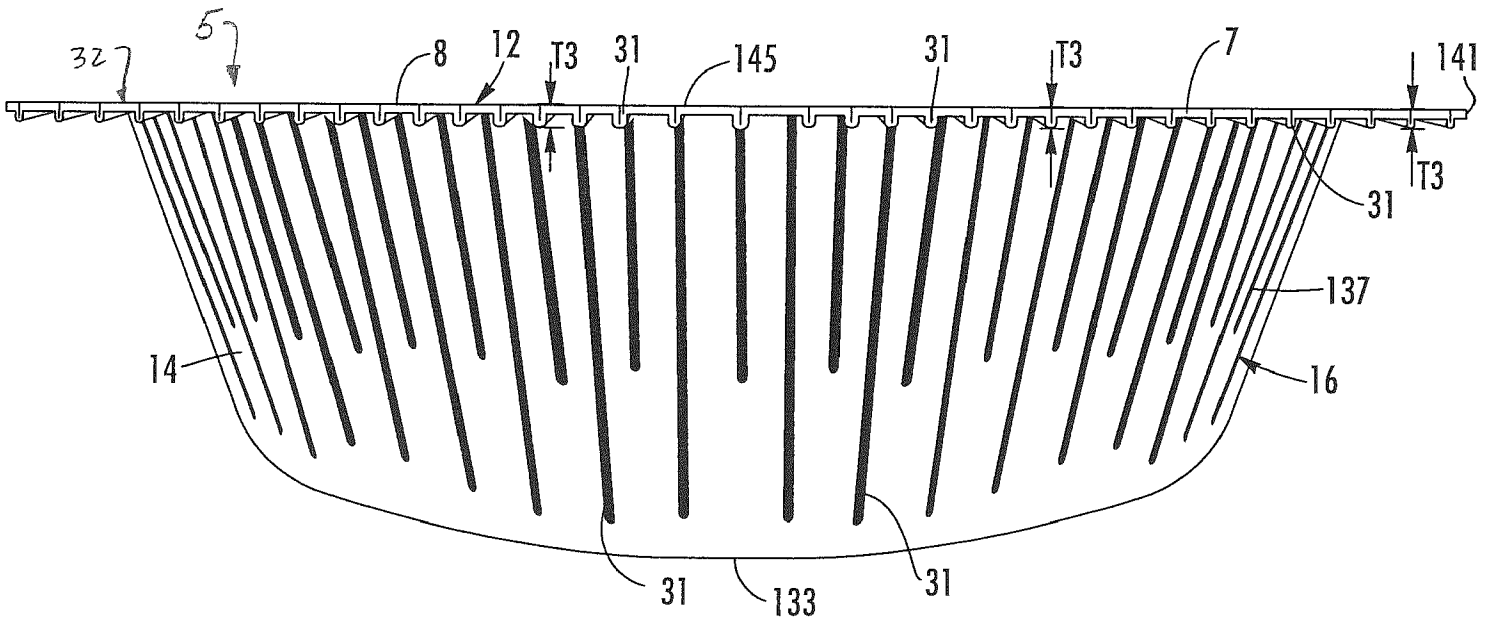
FIG. 7 is a side elevation view of the container of FIG. 6.
Figure 8:
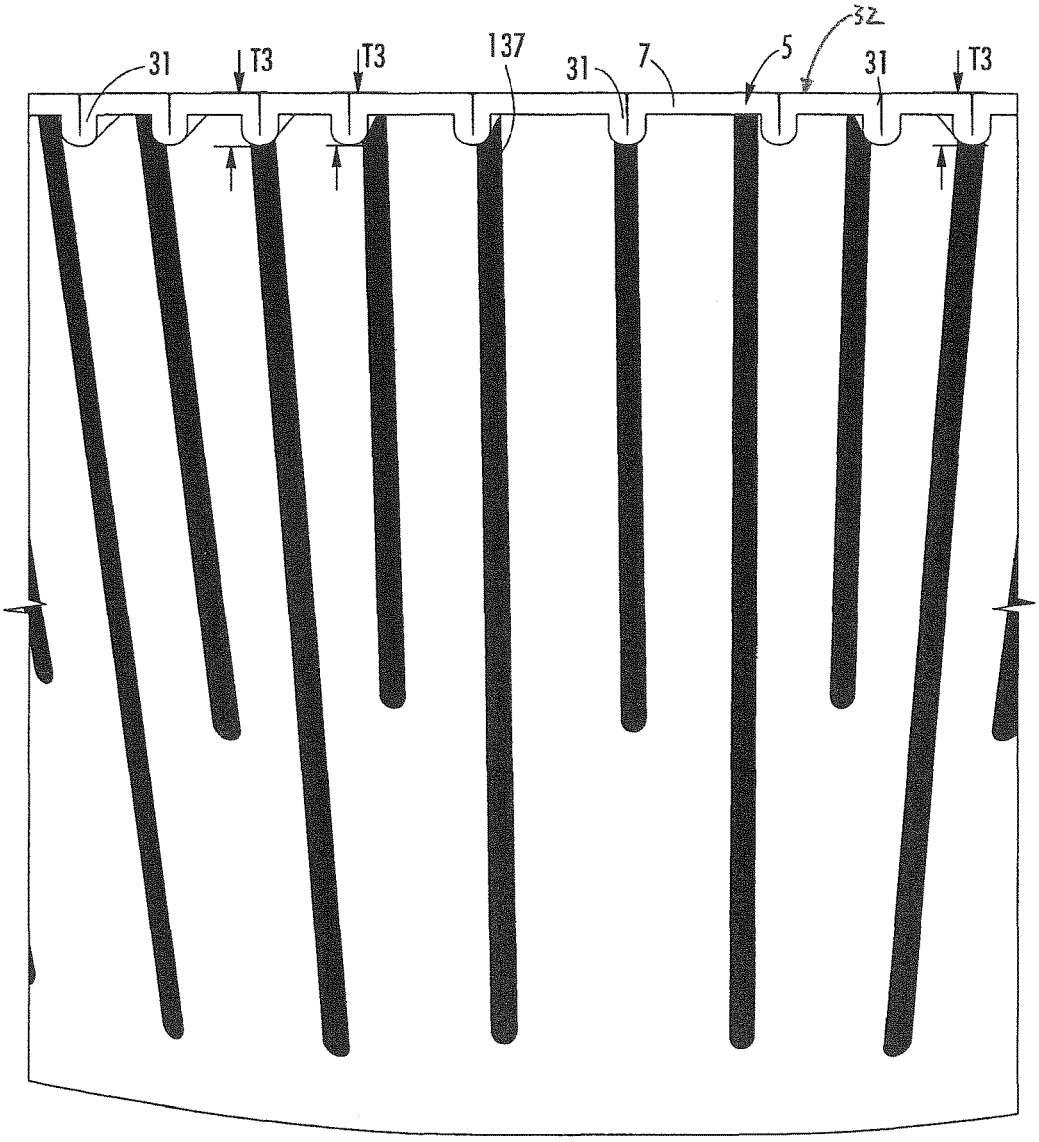
FIG. 8 is an enlarged portion of FIG. 7.
Figure 9:
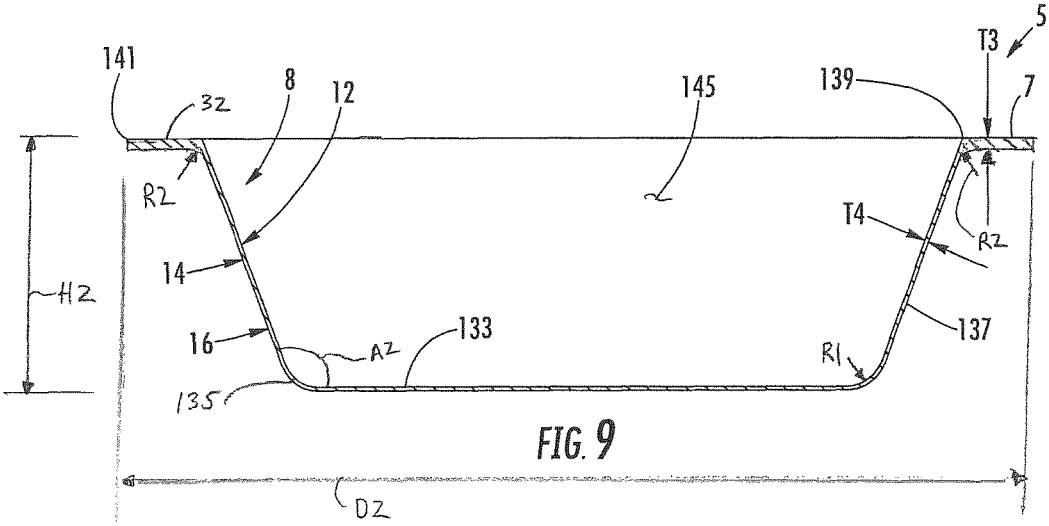
FIG. 9 is a section view of the container of FIG. 6.
Figure 10:
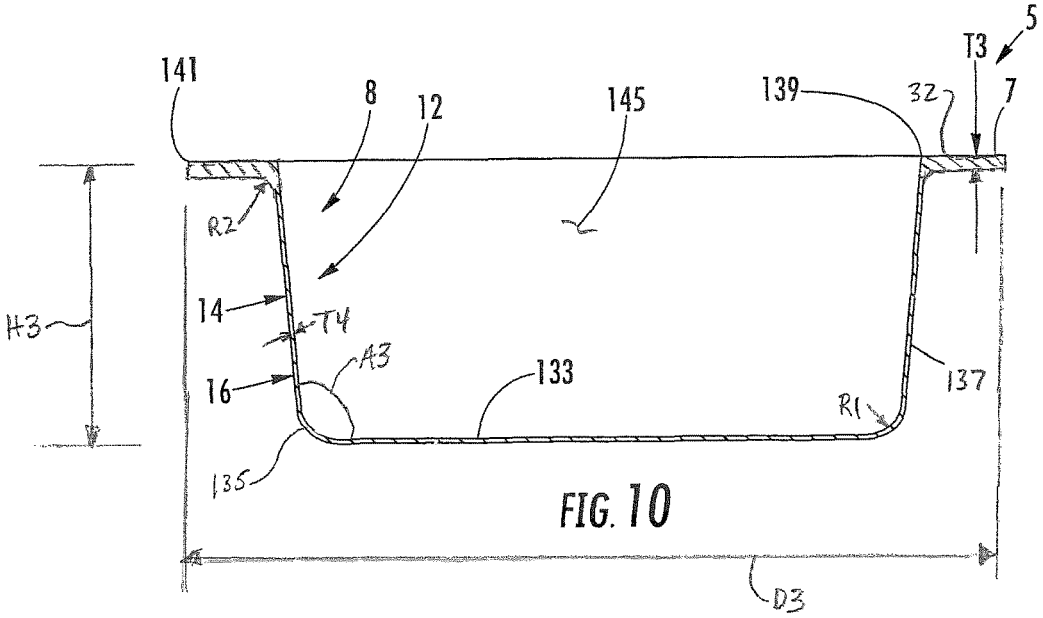
FIG. 10 is a section view of a container of a third embodiment of the disclosure.
Figure 11:
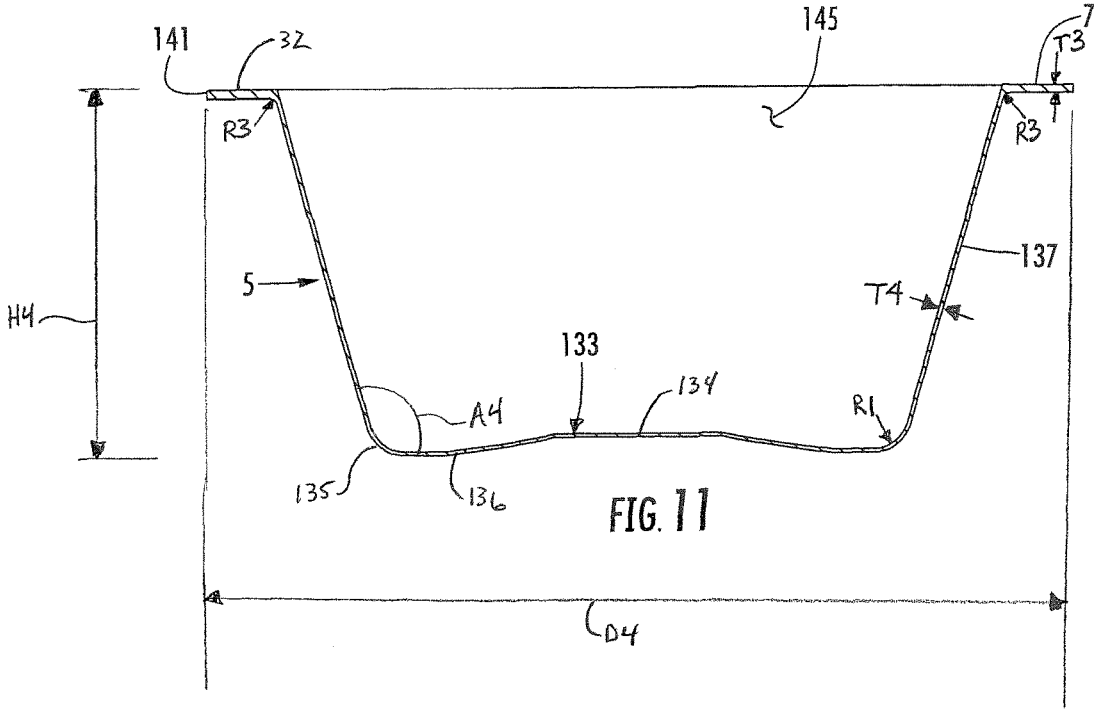
FIG. 11 is a section view of a container of a fourth embodiment of the disclosure.

In the embodiment of FIGS. 6-9, the flange 7 has a thickness T3. As best shown in FIGS. 10 and 11, the thickness of the flange includes the height of the protrusion resulting from the overlapped portions that form the pleats 31. As shown in FIGS. 7 and 8, the flange 7 has a substantially flat top surface 32. In one embodiment, the thickness T3 of the flange 7 can be approximately 0.038 inch (0.97 mm), and can be in the range of approximately 0.033 inch (0.84 mm) to approximately 0.043 inch (1.1 mm). The bottom corner 135 of the container 5 can have a radius R1 of approximately 0.31 inch (7.9 mm), and can be in the range of approximately 0.30 inch (7.6 mm) to approximately 0.32 inch (8.1 mm), and the upper corner 139 can have a radius R2 of approximately 0.125 inch (3.18 mm), and can be in the range of approximately 0.10 inch (2.5 mm) to approximately 0.13 inch (3.3 mm). In the embodiment of FIGS. 8-11 the side wall 137 can have a thickness T4 of approximately 0.025 inch (0.64 mm) that includes the height of the overlapped portions of the pleats 31 that extend into the side wall. Alternatively, the thickness T4 could be in the range of approximately 0.02 inch (0.5 mm) to approximately 0.03 inch (0.8 mm). Alternatively, the thickness T4 of the side wall 137 could be substantially equal to the thickness T3 of the flange 7. As shown in FIG. 9, the side wall 137 has an angle A2 relative to the bottom wall 133 of approximately 21 degrees, an overall height H2 of approximately 1.6 inches (40 mm), and an overall diameter D2 of approximately 5.8 inches (147 mm).

The container 5 could be otherwise shaped, arrange, configured, and/or dimensioned without departing from this disclosure. For example, FIG. 10 shows another embodiment of the container 5 that is similar to the embodiment of FIGS. 6-9 but has different dimensional information. The side wall 137 and the flange 7 of the container 5 of FIG. 10 have the same thickness as the corresponding side wall and flange of the embodiment of FIGS. 6-9 (T4 and T3, respectively). Also, the radius R1 of the bottom corner 135 and the radius R2 of the top corner 139 of the container 5 of FIG. 10 are the same as the corresponding radii of the embodiment of FIGS. 6-9. However, the container 5 of FIG. 10 has an angle A3 relative to the bottom wall 133 of approximately 17 degrees, an overall height H3 that is approximately 1.26 inches (32.0 mm), and an overall diameter D3 of approximately 4.9 inches (124 mm).

FIG. 11 shows another embodiment of the container 5 that is similar to the embodiment of FIG. 8, but has different dimensional information as indicated. The bottom wall 133 of the container 5 of FIG. 13 is curved and has a central portion 134 that is raised above an outer annular portion 136 that is adjacent the bottom corner 135. As shown in FIG. 11, the side wall 137 and the flange 7 of the container 5 of FIG. 11 have the same thickness as the corresponding side wall and flange of the embodiments of FIGS. 9 and 10 (T4 and T3, respectively). The bottom corner 135 of the container 4 of FIG. 11 has the same radius R1 as the corresponding bottom radius of the embodiments of FIGS. 9 and 10. The upper corner 139 can have a radius R3 of approximately 0.047 inch (1.2 mm), and can be in the range of approximately 0.042 inch (1.1 mm) to approximately 0.52 inch (1.3 mm). The container 5 of FIG. 11 has an angle A4 relative to the bottom wall 133 of approximately 16 degrees, an overall height H4 that is approximately 1.56 inches (39.6 mm), and an overall diameter D4 of approximately 3.6 inches (91 mm).

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

As shown in FIGS. 12-14, the forming tool 9 comprises a cavity block 151 that is part of a lower tool assembly 152 (broadly "second tool assembly), and a punch or nose 153 that is part of an upper tool assembly 154 (broadly "first tool assembly"). The cavity block 151 has a bottom wall 155, a lower corner 157 that connects the bottom wall to an annular side wall 159, an upper corner 161 that connects the sidewall to an upper surface 163. The bottom wall 155, lower corner 157, annular side wall 159, upper corner 161 form a recess 164 in the cavity block 151 below the upper surface 163. The upper surface 163 supports the flange 7 when the punch 153 has been received into the recess 164 of the cavity block 151 to form the blank 3 into the container 5. The punch 153 has an outer surface 171 that cooperates with the upper surface 163 of the cavity block 151 to form the flange 7 having the desired thickness. The recess 164 and upper surface 163 of the cavity block 151 are generally shaped to correspond with the desired shape of the container 5.

The upper corner 161 is a rounded surface between the flat upper surface 163 and the flat side wall surface 159 that has an increased radius to minimize forces that occur when the blank 3 is pulled over the upper corner of the forming tool 9 during formation of the container 5 from the blank. The upper corner 161 forms the upper corner 139 of the container 5 that connects the flange 7 to the side wall 137. In one embodiment, the upper corner 161 has a radius R5 of approximately 0.125 inch (3.18 mm), and in the range of approximately 0.047 inch (1.2 mm) to approximately 0.13 inch (3.3 mm). Also, the lower corner 157 is a rounded surface between the flat annular side wall 159 and the flat bottom wall 155 that has an increased radius to minimize forces that occur when the bottom corner 135 of the container 45 is formed. In one embodiment, the lower corner 157 has a radius R6 of approximately 0.31 inch (7.9 mm), and can be in the range of approximately 0.30 (7.6 mm) inch to approximately 0.32 inch (8.1 mm)

In one embodiment, the blank 3 is formed into the container by conveying a blank and placing the blank in the forming tool 9 when the lower tool assembly 152 and upper tool assembly are in a separated or open position. The forming tool 9 is used to press form the blank 3 into the container 5 by moving the tool assemblies 152, 154 together, to a closed position (FIGS. 12-14), in a manner such that the punch 153 is pressed against the blank 3 to force the blank into the cavity 164 of the cavity block 151. When the flat blank 3 is pressed into the cavity 154, the substrate 14 and microwave interactive material 8 layers are compressed and formed into the three-dimensional container 5 by closing the forming tool 9. The score lines 19 facilitate forming the flat blank into the three-dimensional container in the forming tool 9. The score lines 19 allow formation of the marginal portion 15 of the blank 3 into the side wall 137 and flange 7 of the container 5. The flange 7 is formed by being pressed between the outer surface 171 of the nose 153 and the flat upper surface 163 of the cavity block 151.

The forming tool 9 is configured to provide the flange 7 with increased thickness T3 as compared to the thickness T4 of the side wall 137 to prevent fracturing of the microwave interactive layer 8 when the blank 3 is compressed between the punch 153 and the cavity block 151. In one embodiment, the flange 7 has a thickness T3 that is at least approximately twice the thickness $T_b$ (FIG. 1A) of the blank 3. For example, the thickness T3 of the flange 7 can be approximately 0.038 inch (0.97 mm) and the thickness $T_b$ of the blank 3 can be approximately 0.019 inch (0.48 mm). Also, the tool 9 is configured to produce the container 5 having a radius (e.g., R1) at the bottom corner 135 of the container 5 and a radius (e.g., R2, R3) at the top corner 139 of the container 5. Because the flange 7 of the container 5 is formed with a lower amount of compression than the amount of compression that forms the side wall 137, the flange has a greater thickness T3 than the thickness T4 of the side wall. The lower amount of compression of the flange 7 prevents the foil of the microwave interactive layer 8 from rupturing at the pleats 31 in the flange.

In one aspect, for example, any of the blanks 3 can comprise paperboard having a basis weight of from about 60 to about 330 lbs/ream, (about 27 to about 148 Kg/ream wherein a ream equals 3,000 $ft^2$ or 279 $m^2$), for example, from about 80 to about 140 lbs/ream (about 36 Kg/ream to about 63 Kg/ream). The paperboard generally may have a thickness of from about 6 to about 30 mils, for example, from about 12 to about 28 mils. In one particular example, the paperboard has a thickness of at least about 12 mils. Any suitable paperboard may be used, for example, a solid bleached or solid unbleached sulfate board, such as SUS® board, commercially available from Graphic Packaging International. In another aspect, where a more flexible construct is to be formed, the blank may comprise a paper or paper-based material generally having a basis weight of from about 15 to about 60 lbs/ream (about 6.75 Kg/ream to about 27 Kg/ream), for example, from about 20 to about 40 lbs/ream (about 9 Kg/ream to about 18 Kg/ream). In one particular example, the paper has a basis weight of about 25 lbs/ream (about 11 Kg/ream).

Optionally, one or more portions of the blank or other constructs described herein or contemplated hereby may be coated with varnish, clay, or other materials, either alone or in combination. The coating may then be printed over with product advertising or other information or images The blanks or other constructs also may be selectively coated and/or printed so that less than the entire surface area of the blank or substantially the entire surface area of the blank may be coated and/or printed.

Further, the container 5 may cooperate with a lid (not shown) for heating and/or cooking a food product that is held in the container without departing from the disclosure.

Any of the blanks 3, containers 5, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A method of manufacturing a container for holding and heating a food product, the method comprising:

obtaining a blank comprising a central portion, an outer edge, and a marginal portion between the outer edge and the central portion, the blank comprising a radius extending from a center of the blank to the outer edge, the marginal portion comprising a plurality of radial score lines having an angular spacing between respective adjacent radial score lines, the blank having a first thickness;

positioning the blank in a forming tool;

closing the forming tool comprising compressing the blank; and forming a container having a bottom panel, at least one side panel extending upwardly from the bottom panel, and a flange extending laterally outward from an upper edge of the at least one side panel, wherein the forming the container comprises:

forming a cavity by upwardly folding the side panel relative to the bottom panel, and forming a plurality of pleats at the radial score lines, each pleat extending in the flange and extending into at least a portion of the at least one side panel, and compressing each pleat to a second thickness along the entire radial length of the flange from the upper edge of the at least one side panel to a free edge of the flange and compressing each pleat to a third thickness that is different than the second thickness along the at least a portion of the side panel, the second thickness being approximately two times the first thickness and the second thickness being greater than the third thickness, each pleat being radially spaced apart from an adjacent pleat by a portion of the flange having a thickness that is less than the second thickness.

2. The method of claim 1 wherein the plurality of pleats are radially interspersed by portions of the side panel having a thickness less than the third thickness.

3. The method of claim 2 wherein the forming the plurality of pleats comprises overlapping portions of the blank at the score lines to form overlapped portions of the blank along at least a portion of the flange and at least a portion of the at least one side panel.

4. The method of claim 3 wherein the overlapped portions of the blank along the at least a portion of the flange include protrusions that extend from a lower surface of the flange and have a height, and the closing the forming tool comprises compressing the overlapped portions of the flange to the second thickness that includes the height of the protrusions.

5. The method of claim 4 wherein the closing the forming tool comprises forming a substantially flat top surface of the flange.

6. The method of claim 4 wherein the overlapped portions of the blank extend from the free edge of the flange and into at least a portion of the at least one side panel.

7. The method of claim 6 wherein the closing the forming tool comprises compressing the overlapped portions of the blank along the at least a portion of the at least one side panel to the third thickness.

8. The method of claim 1 wherein the closing the forming tool further comprises forming at least one first corner formed at a first junction between the at least one side panel and the flange and forming at least one second corner at a second junction between the at least one side panel and the bottom panel.

9. The method of claim 8 wherein the at least one first corner and the at least one second corner are curved.

10. The method of claim 8 wherein the forming tool comprises a first tool assembly and a second tool assembly, at least one of the first tool assembly and the second tool assembly is moveable between an open position wherein the blank is received between the first and the second tool assembly and a closed position wherein the blank is formed into the container, the first tool assembly comprises a nose having an external surface shaped to generally correspond to at least a portion of the container and the second tool assembly comprises a cavity block having a recess shaped to correspond with at least a portion of the container, the closing the blank in the tool comprises compressing the blank between the nose and the cavity block to form the container from the blank when the nose is at least partially received in the cavity block.

11. The method of claim 10 wherein the nose and the cavity block have respective flat surfaces that cooperate to form the flange of the container.

12. The method of claim 10 wherein the nose and the cavity block have respective first curved surfaces that cooperate to form the at least one first corner and the nose and the cavity block have respective second curved surfaces that cooperate to form the at least one second corner.

13. The method of claim 1 wherein the blank comprises a base layer of paperboard and a microwave interactive layer secured to the base layer.

14. The method of claim 1, wherein the plurality of pleats extend in at least a portion of the side panel, the forming the plurality of pleats comprises overlapping portions of the blank at the score lines to form overlapped portions of the blank along at least a portion of the flange and the at least a portion of the side panel, and wherein the closing the forming tool comprises compressing the overlapped portions of the blank along the at least a portion of the side panel to the third thickness.

15. The method of claim 1, wherein each pleat has the second thickness along the entire radial length of the flange from the upper edge of the at least one side panel on an interior surface of the container to the free edge of the flange.

16. The method of claim 15, wherein the upper edge of the at least one side panel on the interior surface of the container faces the cavity.

17. The method of claim 15, wherein the upper edge of the at least one side panel forms an upper corner that connects the at least one side panel to the flange.

* * * * *